US012667208B2

(12) United States Patent
Zhou et al.

(10) Patent No.: US 12,667,208 B2
(45) Date of Patent: Jun. 30, 2026

(54) MODEL CAR DISPLAY DEVICE

(71) Applicant: GUANGDONG CAIPO TECHNOLOGY CO., LTD., Shantou (CN)

(72) Inventors: Yibo Zhou, Shantou (CN); Jinhong Zhou, Shantou (CN)

(73) Assignee: GUANGDONG CAIPO TECHNOLOGY CO., LTD., Shantou (CN)

( * ) Notice: Subject to any disclaimer, the term of this patent is extended or adjusted under 35 U.S.C. 154(b) by 45 days.

(21) Appl. No.: 19/023,578

(22) Filed: Jan. 16, 2025

(65) Prior Publication Data

US 2026/0157545 A1 Jun. 11, 2026

(30) Foreign Application Priority Data

Dec. 6, 2024 (CN) ..... 202423011236.3

(51) Int. Cl.
*A47F 7/00* (2006.01)
*B65D 73/00* (2006.01)

(52) U.S. Cl.
CPC ..... *A47F 7/00* (2013.01); *B65D 73/0064* (2013.01); *A47F 2007/0092* (2013.01)

(58) Field of Classification Search
CPC ..... A47F 7/00; A47F 2007/0092; B65D 73/0064
See application file for complete search history.

(56) References Cited

U.S. PATENT DOCUMENTS 5,505,351 A * 4/1996 Najarian ..... B65D 73/0064 223/DIG. 2
6,315,258 B1 * 11/2001 Myler ..... A47F 5/083 211/95
6,581,894 B1 * 6/2003 Tong ..... B65D 73/0064 248/314
6,883,767 B1 * 4/2005 Huang ..... A47F 5/0006 206/378
2002/0027092 A1 * 3/2002 Hu ..... B65D 73/0064 206/349
2005/0051678 A1 * 3/2005 Modesto ..... A47F 7/00 248/121
2005/0218098 A1 * 10/2005 Angen ..... A47B 96/061 211/187
2006/0086636 A1 * 4/2006 Kuo ..... B65D 73/0064 206/349

(Continued)

*Primary Examiner* — Gary C Hoge

(57) ABSTRACT

A model car display device is provided by the present application, which includes a display board main body and a connection part arranged on a chassis of the model car. The connection part is provided with a through-hole; a side wall of the through-hole is equipped with a notch; the display board main body is provided with a positioning pillar; a side wall of the positioning pillar is equipped with a locking strip capable of passing through the notch; the positioning pillar passes through the through-hole; after passing through the notch, the locking strip is positioned on a side of the chassis away from the display board main body; the locking strip is rotated to a position misaligned with the notch. This structure enables quick detachment and connection between the chassis and the display board main body, preventing the displayed model car from becoming loose.

7 Claims, 3 Drawing Sheets

(56) References Cited

U.S. PATENT DOCUMENTS

| | | | | |
|---|---|---|---|---|
| 2007/0007154 | A1* | 1/2007 | Wu | B65D 73/0064<br>206/349 |
| 2007/0187567 | A1* | 8/2007 | Ruane | A47F 7/00<br>248/560 |
| 2008/0272017 | A1* | 11/2008 | Chang | B65D 73/0064<br>206/349 |
| 2009/0134298 | A1* | 5/2009 | Zhang | A47F 5/0006<br>248/309.1 |
| 2012/0074009 | A1* | 3/2012 | Chang | B25H 3/04<br>206/349 |

* cited by examiner

MODEL CAR DISPLAY DEVICE

TECHNICAL FIELD

The present application relates to the technical field of model car display and in particular relates to a model car display device.

BACKGROUND

Model cars are scale models made according to the shape, structure, and color of real vehicles, and are popular among consumers. They have also become an important toy for children. To facilitate consumers in directly observing and understanding the full appearance of the model cars, and to display the model cars in a centralized and flexible manner, model cars are typically suspended on a display board. In existing connection structures between the model cars and the display board, threaded holes are typically made on the model cars, and through-holes are created on the display board. A screw with a head is passed through the through-hole and then screwed into the threaded hole on the model car, locking the model car and the display board together. While this connection structure is simple, it has low connection efficiency, and it is difficult to remove the model car from the display board. In display devices using a snap-fit connection structure, the model car is prone to popping out or loosening during use.

SUMMARY

The purpose of the present application is to address the defects and shortcomings of the prior art and provide a model car display device.

To achieve the above objective, the technical solution adopted by the present application is:

a model car display device includes a display board main body and a connection part arranged on a chassis of the model car; the connection part arranged on the chassis is provided with a through-hole; a side wall of the through-hole is equipped with a notch; the display board main body is provided with a positioning pillar; a side wall of the positioning pillar is equipped with a locking strip capable of passing through the notch; the positioning pillar passes through the through-hole; after passing through the notch, the locking strip is positioned on a side of the chassis away from the display board main body; the locking strip is rotated to a position misaligned with the notch.

Furthermore, a pressing plate is fixed on the connection part arranged on the chassis; the positioning pillar is pressed against the pressing plate after passing through the through-hole.

Furthermore, both ends of the pressing plate are provided with connecting strips; a width of the connecting strips is smaller than a diameter of the pressing plate.

Furthermore, a diameter of the positioning pillar is equal to a diameter of the through-hole.

Furthermore, the display board main body is provided with process holes at positions directly opposite the locking strips.

Furthermore, a number of the notches and a number of the locking strips are both two; the notches are circumferentially distributed around the through-hole; the locking strips are circumferentially distributed around the positioning pillar.

Furthermore, a stopper strip is provided on a surface of the connection part away from the display board main body; the stopper strip is located on a rotation path of the locking strip.

After adopting the above structure, the beneficial effects of the present application are as follows: the positioning pillar can be rotated within the through-hole; before the display board main body is connected to the chassis, the locking strip and the notch are aligned, and the positioning pillar is aligned with the through-hole; then, as the positioning pillar is inserted into the through-hole, the locking strip enters the opposite side of the display board main body through the notch; after that, by rotating the display board main body and the car chassis relative to each other by a certain angle, the locking strip and the notch become misaligned; when the display board main body is suspended on the chassis, it cannot be directly pulled out from the chassis, thus achieving a quick connection between the chassis and the display board main body; when the chassis needs to be detached from the display board main body, the display board main body and the chassis are rotated relative to each other until the locking strip and the notch are aligned, and the locking strip can be directly pulled out from the notch to achieve disassembly; this structure enables quick assembly and disassembly between the chassis and the display board main body, improving the efficiency of model car display mounting and dismounting, and preventing the model car from loosening during display.

DETAILED DESCRIPTION OF THE PREFERRED EMBODIMENT

The following is a further explanation of the present application in conjunction with the accompanying drawings.

Figure 1:
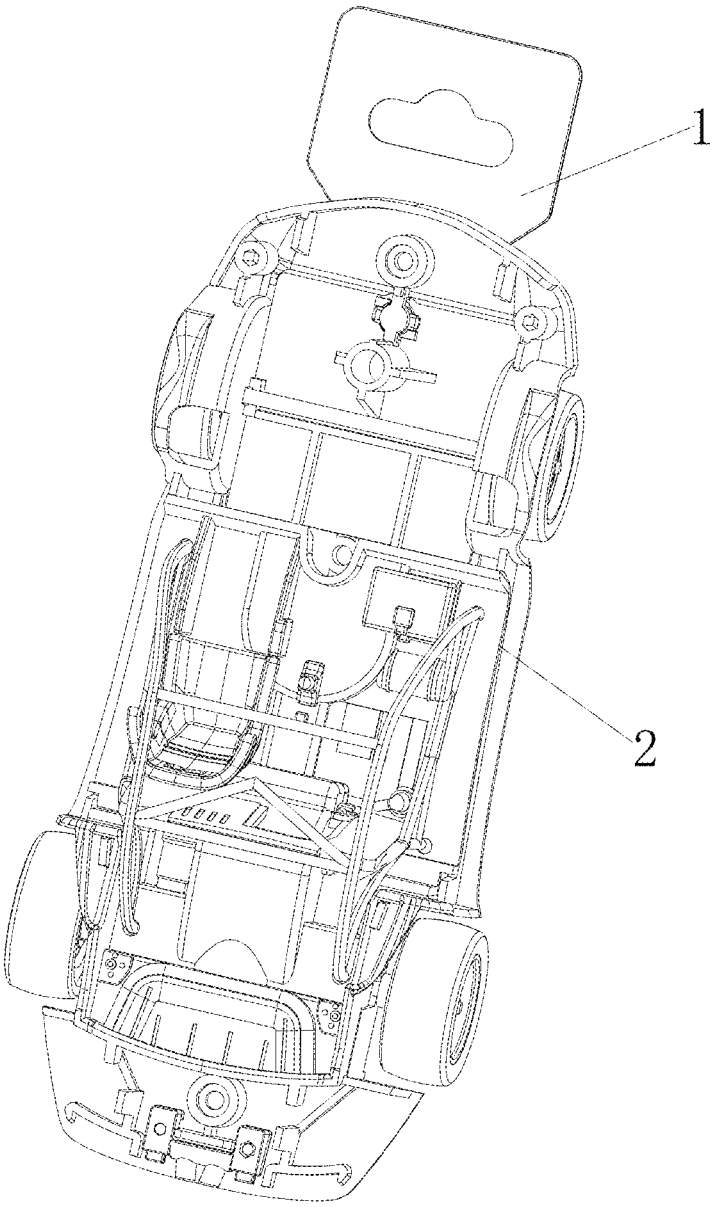
FIG. 1 is a schematic diagram of the structure of the present application.
Figure 2:
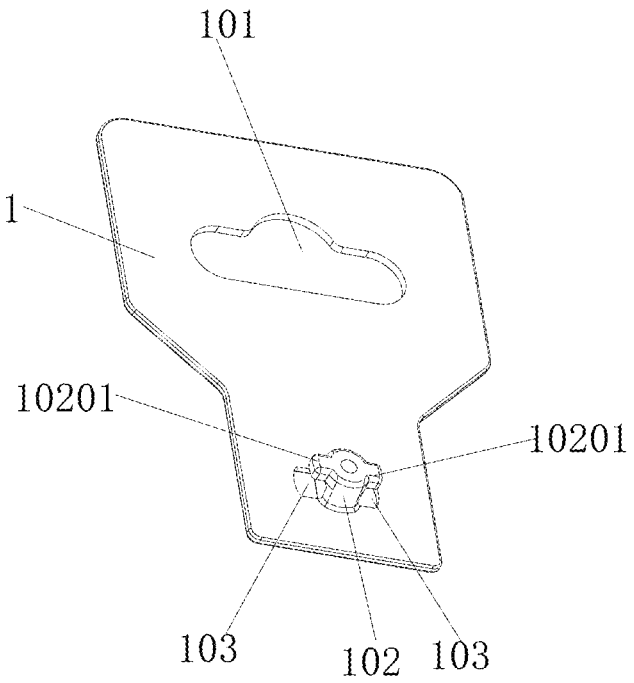
FIG. 2 is a structural diagram of the display board main body.
Figure 3:
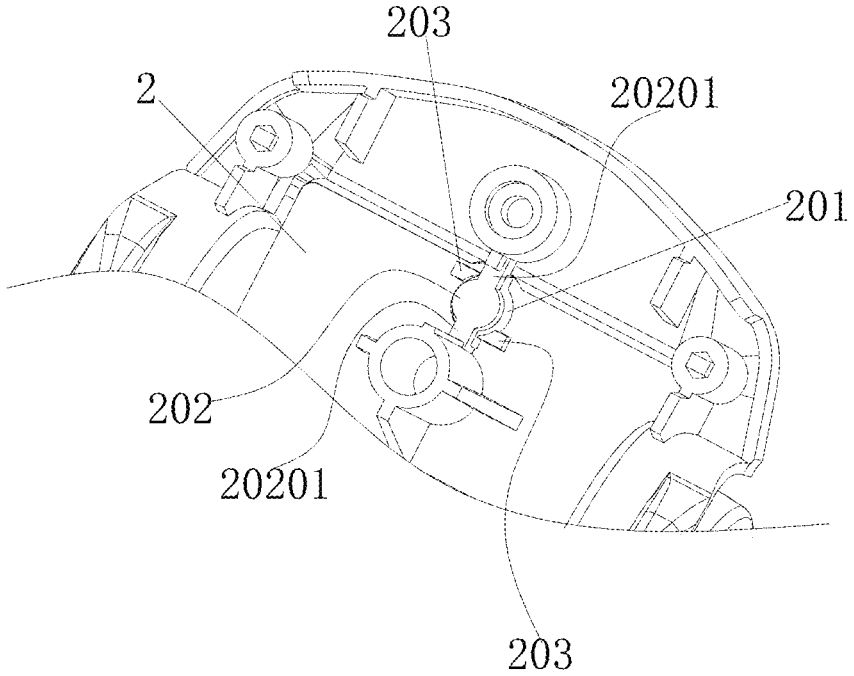
FIG. 3 is a partial view of the chassis from the first perspective.
Figure 4:
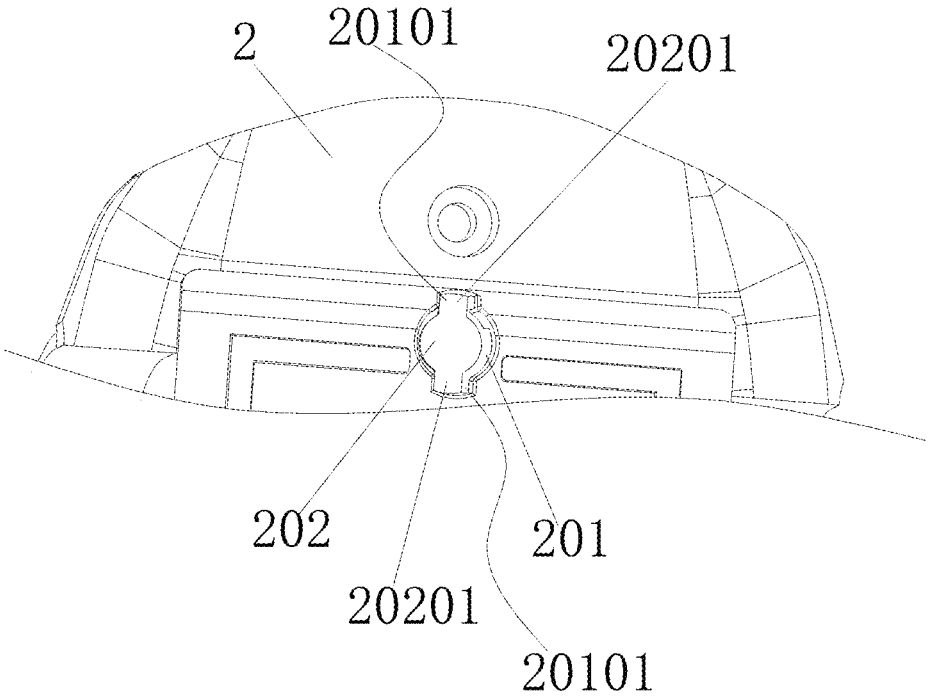
FIG. 4 is a partial view of the chassis from the second perspective.

As shown in FIGS. 1 to 4, a model car display device of the present application includes a display board main body 1 and a connection part arranged on a chassis 2 of the model car; the connection part arranged on the chassis 2 is provided with a through-hole 201; a side wall of the through-hole 201 is equipped with a notch 20101; the display board main body 1 is provided with a positioning pillar 102; a side wall of the positioning pillar 102 is equipped with a locking strip 10201 capable of passing through the notch 20101; the positioning pillar 102 passes through the through-hole 201; after passing through the notch 20101, the locking strip 10201 is positioned on a side of the chassis 2 away from the display board main body 1; the locking strip 10201 is rotated to a position misaligned with the notch 20101.

The display board main body 1 is provided with a display board hole 101. The positioning pillar 102 can be rotated within the through-hole 201. Before the display board main body 1 is connected to the chassis 2, the locking strip 10201 is aligned with the notch 20101, and the positioning pillar 102 is aligned with the through-hole 201. Then, as the positioning pillar 102 is inserted into the through-hole 201, the locking strip 10201 enters the opposite side of the display board main body 1 through the notch 20101. Afterward, by rotating the display board main body 1 and the chassis 2 relative to each other by a certain angle, the locking strip 10201 becomes misaligned with the notch 20101. When the display board main body 1 is suspended on the chassis 2, it cannot be directly pulled out from the chassis 2, thus achieving a quick connection between the chassis 2 and the display board main body 1.

When it is necessary to detach the chassis 2 from the display board main body 1, the display board main body 1 and the chassis 2 are rotated relative to each other until the locking strip 10201 aligns with the notch 20101, and the locking strip 10201 can then be directly pulled out from the notch 20101 to achieve disassembly.

This structure enables quick assembly and disassembly between the chassis 2 and the display board main body 1, improving both connection efficiency and disassembly efficiency.

As a preferred embodiment of the present application, a pressing plate 202 is fixed to the connection part on the chassis 2; the positioning pillar 102, after passing through the through-hole 201, is pressed against the pressing plate 202. By using the pressing plate 202 to press against the positioning pillar 102, the locking strip 10201 is pressed against the surface of the chassis 2, creating friction between the locking strip 10201 and the chassis 2, as well as between the pressing plate 202 and the positioning pillar 102. This makes it difficult for the positioning pillar 102 to rotate freely within the through-hole 201, thereby preventing loosening.

As a preferred embodiment of the present application, both ends of the pressing plate 202 are provided with connecting strips 20201; the width of the connecting strips 20201 is smaller than the diameter of the pressing plate 202. The model car is made of plastic material, and the connecting strips 20201 have a small width and strong bending performance, so that after the pressing plate 202 is pressed against the positioning pillar 102, the connecting strips 20201 can undergo slight bending deformation. This results in the pressing plate 202 exerting elastic pressure on the positioning pillar 102, further enhancing the friction between the locking strip 10201 and the chassis 2, as well as between the pressing plate 202 and the positioning pillar 102, thereby further improving the anti-loosening effect.

As a preferred embodiment of the present application, the diameter of the positioning pillar 102 is equal to the diameter of the through-hole 201. When the diameter of the positioning pillar 102 is equal to that of the through-hole 201, the positioning pillar 102 will not wobble after being inserted into the through-hole 201, resulting in stronger connection stability.

As a preferred embodiment of the present application, the display board main body 1 is provided with process holes 103 at positions corresponding to the locking strip 1021; the presence of the process holes 103 simplifies the mold structure by eliminating the need for a core pull during the forming of the locking strip 1021.

As a preferred embodiment of the present application, the number of the notches 20101 and the number of locking strips 10201 are both two; the notches 20101 are circumferentially distributed around the through-hole 201; the locking strips 10201 are circumferentially distributed on the positioning pillar 102.

As a preferred embodiment of the present application, a stopper strip 203 is provided on the surface of the chassis 2, away from the display board main body 1; the stopper strip 203 is positioned on the rotation path of the locking strip 10201; the number of the locking strips 10201 is the same as the number of the stopper strips 203. The stopper strips 203 limit the rotation angle of the locking strips 10201, ensuring that after the display board main body 1 is connected to the chassis 2, the length direction of the display board main body 1 aligns with the length direction of the chassis 2, thereby enhancing the display effect of the model car.

The above descriptions are merely preferred embodiments of the present application, so any equivalent changes or modifications made based on the structure, features, and principles described in the scope of the patent application for this application are included within the scope of this patent application.

The invention claimed is:

1. A model car display device, characterized in that, includes a display board main body (1) and a connection part arranged on a chassis (2) of the model car; the connection part arranged on the chassis (2) is provided with a through-hole (201); a side wall of the through-hole (201) is equipped with a notch (20101); the display board main body (1) is provided with a positioning pillar (102); a side wall of the positioning pillar (102) is equipped with a locking strip (10201) capable of passing through the notch (20101); the positioning pillar (102) passes through the through-hole (201); after passing through the notch (20101), the locking strip (10201) is positioned on a side of the chassis (2) away from the display board main body (1); the locking strip (10201) is rotated to a position misaligned with the notch (20101).

2. A model car display device according to claim 1, characterized in that, a pressing plate (202) is fixed on the connection part arranged on the chassis (2); the positioning pillar (102) is pressed against the pressing plate (202) after passing through the through-hole (201).

3. A model car display device according to claim 2, characterized in that, both ends of the pressing plate (202) are provided with connecting strips (20201); a width of the connecting strips (20201) is smaller than a diameter of the pressing plate (202).

4. A model car display device according to claim 1, characterized in that, a diameter of the positioning pillar (102) is equal to a diameter of the through-hole (201).

5. A model car display device according to claim 1, characterized in that, the display board main body (1) is provided with process holes (103) at positions directly opposite the locking strips (10201).

6. A model car display device according to claim 1, characterized in that, a number of the notches (20101) and a number of the locking strips (10201) are both two; the notches (20101) are circumferentially distributed around the through-hole (201); the locking strips (10201) are circumferentially distributed around the positioning pillar (102).

7. A model car display device according to claim 1, characterized in that, a stopper strip (203) is provided on a surface of the connection part away from the display board main body (1); the stopper strip (203) is located on a rotation path of the locking strip (10201).

* * * * *